US010306955B2

(12) United States Patent
Ressler

(10) Patent No.: US 10,306,955 B2
(45) Date of Patent: Jun. 4, 2019

(54) ZIPPER FASTENER SYSTEM

(71) Applicant: Dutch Clips LLC, Reinholds, PA (US)

(72) Inventor: Thomas Ressler, Reinholds, PA (US)

(73) Assignee: Dutch Clips LLC, Reinholds, PA (US)

( * ) Notice: Subject to any disclaimer, the term of this patent is extended or adjusted under 35 U.S.C. 154(b) by 301 days.

(21) Appl. No.: 15/251,694

(22) Filed: Aug. 30, 2016

(65) Prior Publication Data

US 2017/0095042 A1 Apr. 6, 2017

Related U.S. Application Data

(60) Provisional application No. 62/236,563, filed on Oct. 2, 2015.

(51) Int. Cl.

| | |
|---|---|
| ***A44B 19/38*** | (2006.01) |
| ***A45C 13/10*** | (2006.01) |
| *A44B 19/28* | (2006.01) |

(52) U.S. Cl.

CPC ..... *A44B 19/382* (2013.01); *A45C 13/103* (2013.01); *A44B 19/28* (2013.01)

(58) Field of Classification Search

CPC ..... A44B 19/382; A44B 19/28; A44B 19/384; A45C 13/103

See application file for complete search history.

(56) References Cited

U.S. PATENT DOCUMENTS

2002/0142123 A1* 10/2002 Yamaguchi ..... A45C 7/0059 428/58
2007/0137959 A1* 6/2007 Zauderer ..... A45C 3/08 190/110

FOREIGN PATENT DOCUMENTS

DE 102014116104 A1 * 5/2016 ..... A44B 19/382
GB 2030212 A * 4/1980 ..... A44B 19/28

* cited by examiner

*Primary Examiner* — Robert Sandy
*Assistant Examiner* — Louis A Mercado
(74) *Attorney, Agent, or Firm* — Barley Snyder

(57) ABSTRACT

A zipper fastener system is provided for removably connecting separate structures. More particularly, a zipper fastener system is provided having connection sections attached to independent pieces that may be secured to and removed from each other utilizing two sliders, such that, when the connection sections are secured to each other, the two sliders permit an access opening of variable length and location along the connection sections and permit adjustments from either side of the zipper fastener system.

20 Claims, 8 Drawing Sheets

ZIPPER FASTENER SYSTEM

CROSS-REFERENCE TO RELATED APPLICATIONS

This application claims the benefit of the filing date under 35 U.S.C. § 119(e) of U.S. Provisional Application No. 62/236,563, filed Oct. 2, 2015.

FIELD OF THE INVENTION

The invention relates to a zipper fastener system and, more particularly, to a zipper fastener system having a pair of sliders that open there between.

BACKGROUND

Typically, a conventional zipper fastener system generally includes a slider, a pull-tab, a first set of teeth, a second set of teeth that engage with the first set of teeth, an insertion pin, and a retainer box positioned adjacent to and receiving the insertion pin. These components are attached to one or more pieces of material, whereby the slider engages the first set of teeth to the second set of teeth. The insertion pin is positioned in the slider and received in the retainer box. The slider is slid away from the retainer box and interlocks the first set of teeth and the second set of teeth.

It is known that bags and jackets use two sliders in a zipper fastener system to make for easy retrieval of items in the middle of the zipper fastener system. However, these known systems require specific modification along ends of the known zipper fastener system, such that the ends are tucked and secured by stitching.

There is a need for a zipper fastener system having connection sections attached to independent pieces that may be secured to and removed from each other utilizing two sliders, such that, when the connection sections are secured to each other, the two sliders permit an access opening of variable length and location along the connection sections and permit adjustments from either side of the zipper fastener system.

SUMMARY

In view of the aforementioned shortcomings, an object of the invention, among others, is to provide a first embodiment of a zipper fastener system having a first tape section with a first retainer box positioned at one end thereof and a second retainer box positioned opposite the first retainer box at another end thereof, a second tape section with a first retainer pin positioned on one end thereof and a second retainer pin positioned opposite the first retention pin at another end thereof. A second embodiment of the invention is a zipper fastener system having a first tape section with a first retainer box positioned at one thereof and a first retainer pin positioned opposite the first retainer box at another end thereof, a second tape section with a second retainer pin positioned on one end thereof and a second retainer box positioned opposite the second retainer pin at another end thereof. For the first and second embodiments of the zipper fastener system, a set of fastener elements extends along a length of each of the first and set tape sections, respectively. For the first and second embodiments of the zipper fastener system, the first tape section and the second tape section (after insertion of the first and second retainer pins into the first and second retainer boxes, respectively) are removeably joined with a first slider connecting the first tape section with the second tape section, and a second slider connecting the first tape section with the second tape section. The first and second sliders are each independently moveable attached to the first tape section and engageable with the first and second retainer pins of the second tape section and with the first and second retainer boxes, respectively. When the connection sections are secured to each other, the two sliders permit an access opening of variable length and location along the connection sections and permit adjustments from either side of the zipper fastener system.

BRIEF DESCRIPTION OF THE DRAWINGS

The invention will now be described by way of example with reference to the accompanying figures of which.

DETAILED DESCRIPTION OF THE EMBODIMENT(S)

Embodiments of the invention will now be described in greater detail with reference to the accompanying FIGS. 1-13.

Figure 1:
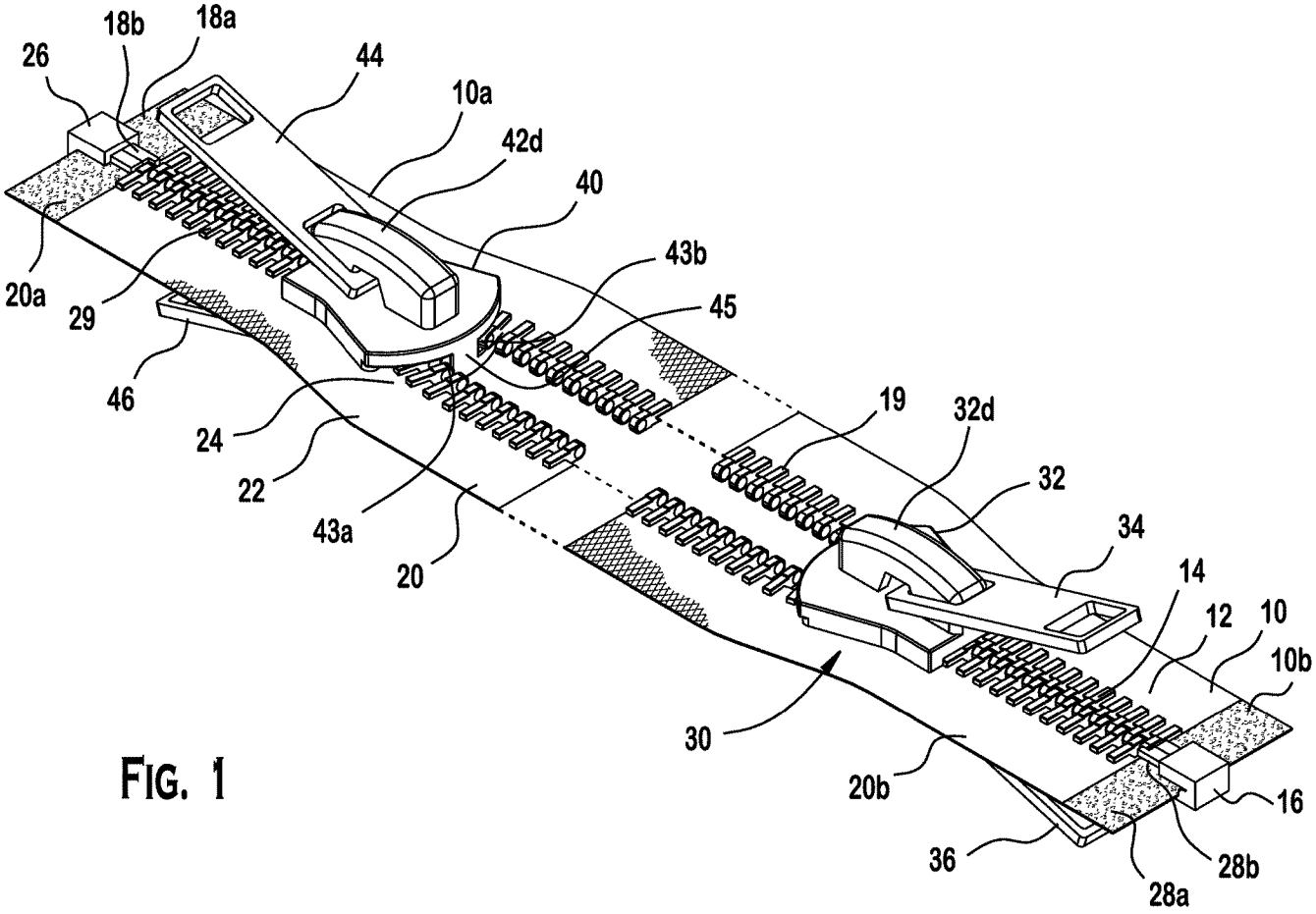
FIG. 1 is a perspective view of a zipper fastener system according to the invention.
Figure 2:
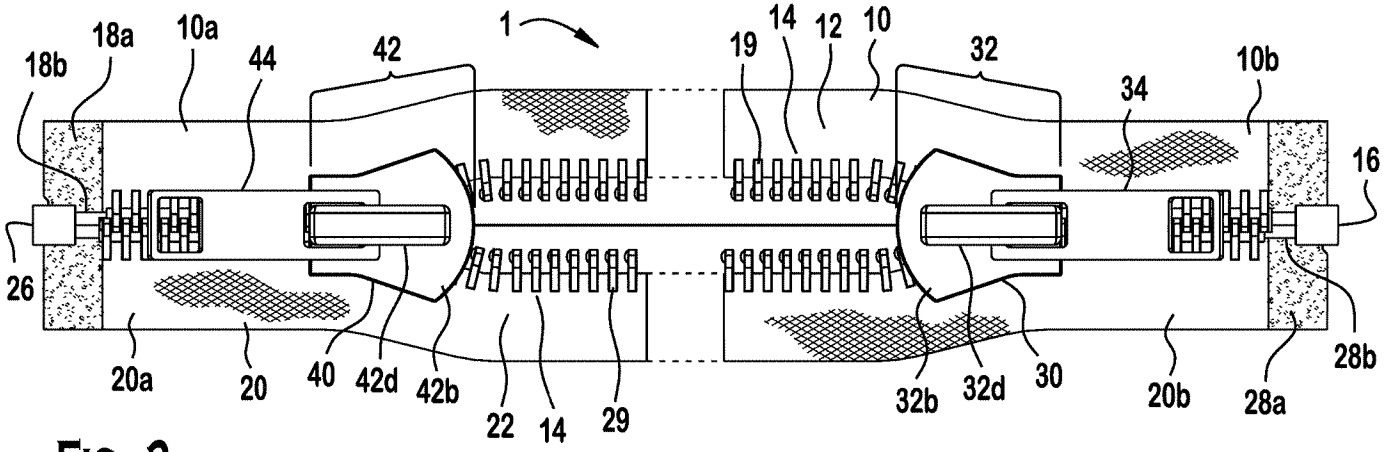
FIG. 2 is a top view of the zipper fastener system of FIG. 1.
Figure 3:
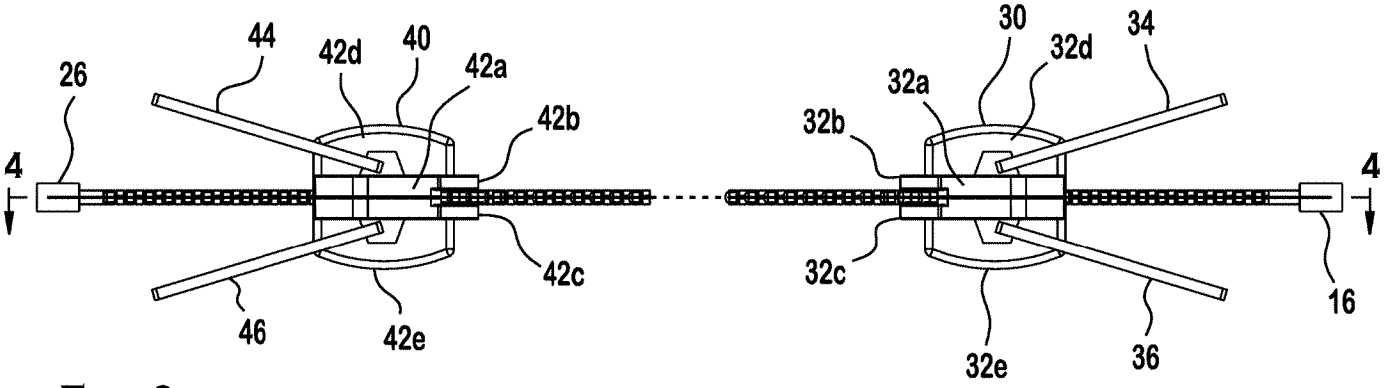
FIG. 3 is a side view of the zipper fastener system of FIG. 1.

First, with reference to FIG. 1, a zipper fastener system 1 according to the invention is shown. Generally, the zipper fastener system 1 includes a first tape section 10, a second tape section 20, a first slider 30, and a second slider 40.

As shown in FIGS. 1-13, the first tape section 10 (having a first end and a second end) includes a first connection section 12, a first set of fastener elements 14, a first retainer box 16, and a first retainer pin 18*b*.

The first connection section 12 (having a first end 12*a* and a second end 12*b*) is a strip of tape that extends along a length thereof. The first connection section 12 can be attached to a first structure (not shown), such as a garment, textile, or other materials, using stitching, mechanical weld, or adhesive. In particular, the first connection section 12 is attached to the first structure (not shown) along a right side thereof. The second connection section 22 is attached to a second structure (not shown) along a left side thereof and is described in more detail below. Removable attachment of the first structure to the second structure is desirable or advantageous. For instance, in one embodiment of the invention, the first structure may be a sleeping bag, a hammock, or a tent. For instance, the second structure may be a second sleeping bag, a second hammock, a second tent, a net, a tarp, a travel bag, etc.

The first set of fastener elements 14 are teeth in the shown embodiment and are positioned along the length of the first connection section 12. The teeth of the first set of fastener elements 14 are positioned on a left side of the first connection section 12 and are generally parallel to each other. The teeth of the first set of fastener elements 14 extend away from the first connection section 12, substantially perpendicular to the length of the first connection section 12.

Figure 4:
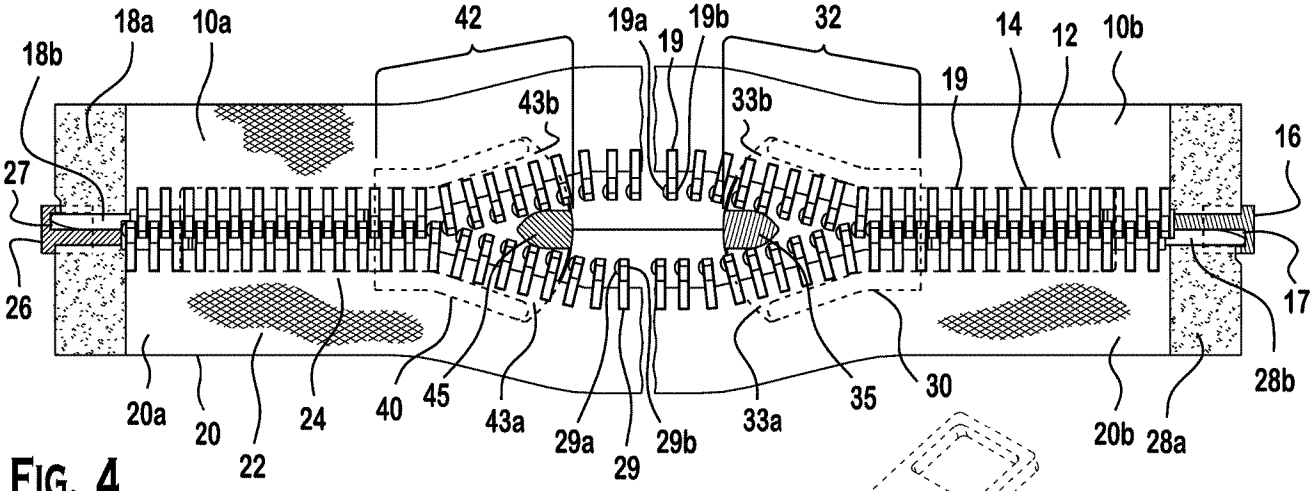
FIG. 4 is a top view of the zipper fastener system of FIG. 3 along line 4-4.
Figure 5:
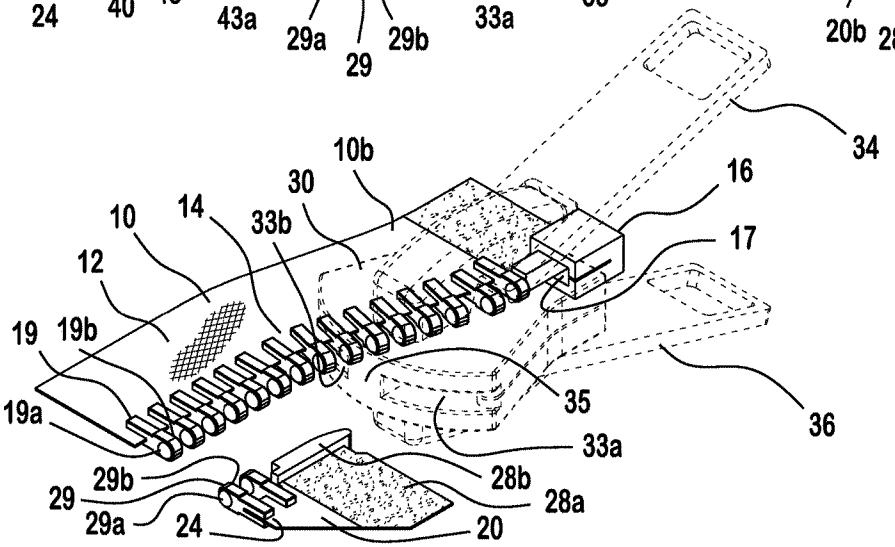
FIG. 5 is a close up perspective view of the zipper fastener system according to the invention showing connection between first and second tape sections.
Figure 13:
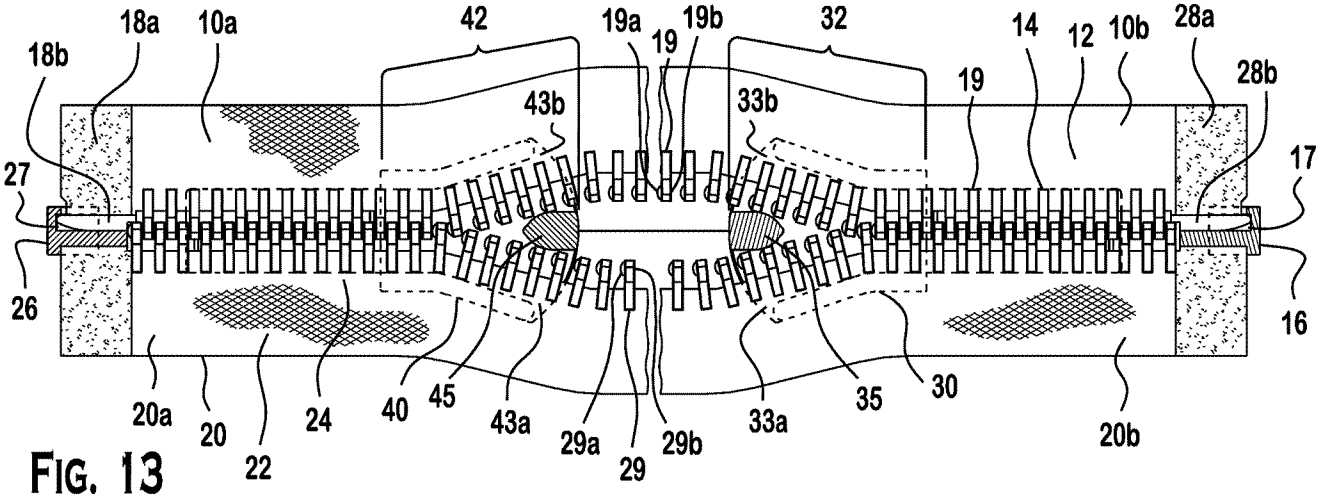
FIG. 13 is a bottom view of the zipper fastener system of FIG. 9.

The fastener elements 14 of the zippers are of various types including those of nylon coil, or plastic, metal, or nylon teeth 19, 29. It is understood that "teeth" or "coil" are used interchangeably herein. The teeth collectively form a connection (zipper track). Each tooth 19, 29 includes a hollow 19*a*, 29*a* on one face and a hook 19*b*, 29*b* on the opposite face. Each zipper fastener system 1 includes two connection sections (or zipper tracks) of teeth which are latched together by operation of the sliders 30, 40. The sliders 30, 40 are independently moved along the two zipper tracks of uniformly sized and shaped teeth 19, 29. Wedge-shaped walls 35, 45 internal to the sliders 30, 40 respectively direct the two zipper tracks of teeth 19, 29 at an angle and into an interlocking relationship with each other. The zipper tracks are offset so that, in sequence, as the slider 30, 40 is drawn along the zipper tracks, a hollow 19*a* of one tooth on one zipper track aligns with a hook 29*b* of the tooth on the other zipper track as shown in FIGS. 4 and 13. The size of the zipper teeth is on the basis of the use to which the zipper fastener system will be subjected. Use of the zipper fastener system in camping equipment suggests a lightweight #3 gauge nylon coil zipper with a polyester tape and teeth that are water-, abrasion-, and UV-resistant and sliders made of molded plastic or metal, but one of ordinary skill in the art can select the particular material specifications to suit particular conditions.

As shown in FIGS. 4-8, the first retainer box 16 is a box structure having a first retainer pin receiving cavity 17. The first retainer pin receiving cavity 17 is sized and shaped to correspond with the second tape section 20 and, more particularly, to receive a second retainer pin 28*b* thereof (which will be described in more detail below). The first retainer box 16 may include a magnet to facilitate assembly with the second tape section 20. As shown in a first embodiment, the first retainer box 16 is attached to a lower end 10*b* of first connection section 12. It is attached so as to prevent its separation from the first connection section 12.

As shown in FIGS. 4-8, the first retainer pin 18*b* includes a first grip member 18*a* positioned adjacent to the first retainer pin 18*b*. The first retainer pin 18*b* is an elongated box shaped member that is generally rigid and dimensioned for insertion into the second slider 40 and the second tape section 20 and, more particularly, for insertion into a second retainer box 26 (which will be described in more detail below). A first tooth member 19 may be provided at the top of the first retainer pin 18*b*. As shown, the first retainer pin 18*b* is attached to an upper end 10*a* of first connection section 12. It is attached so as to prevent separation from the first connection section 12.

Figure 6:
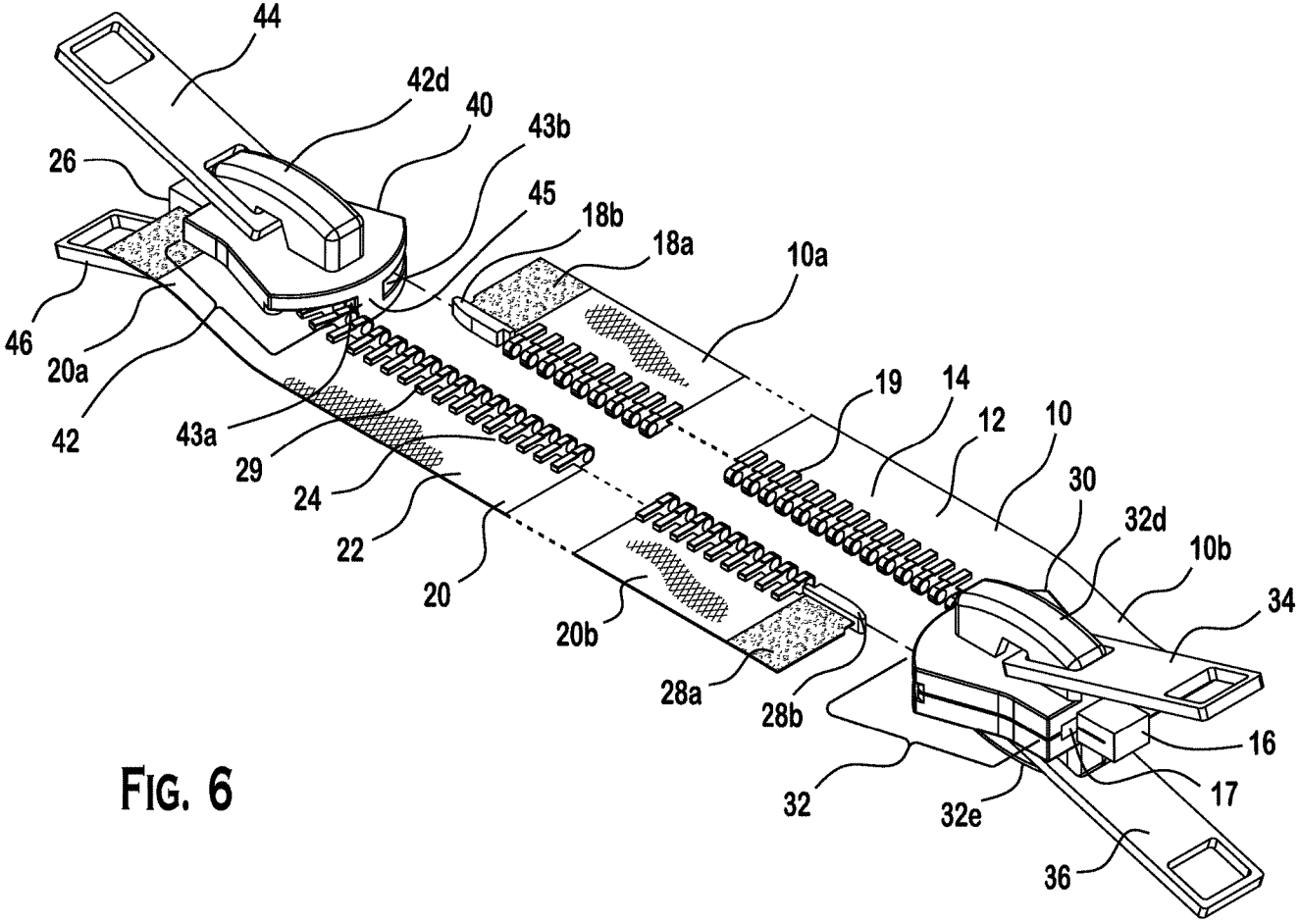
FIG. 6 is another perspective view of the zipper fastener system according to the invention before the first and second tape sections are connected.
Figure 7:
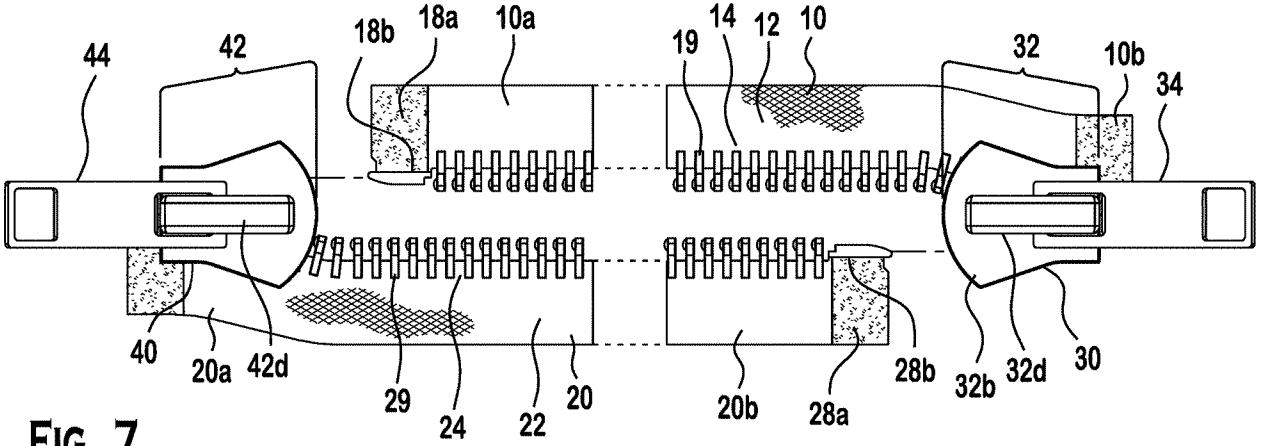
FIG. 7 is a top view of the zipper fastener system of FIG. 6.
Figure 8:
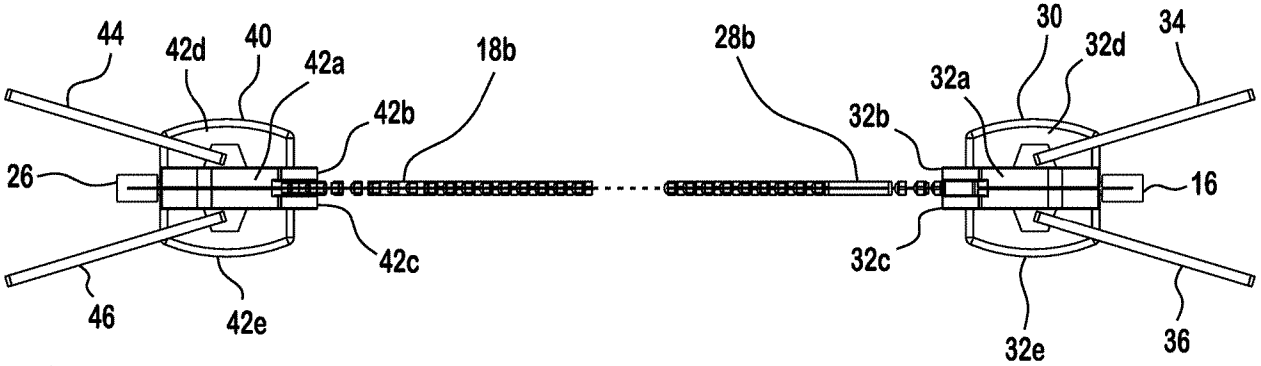
FIG. 8 is a side view of the zipper fastener system of FIG. 6.
Figure 9:
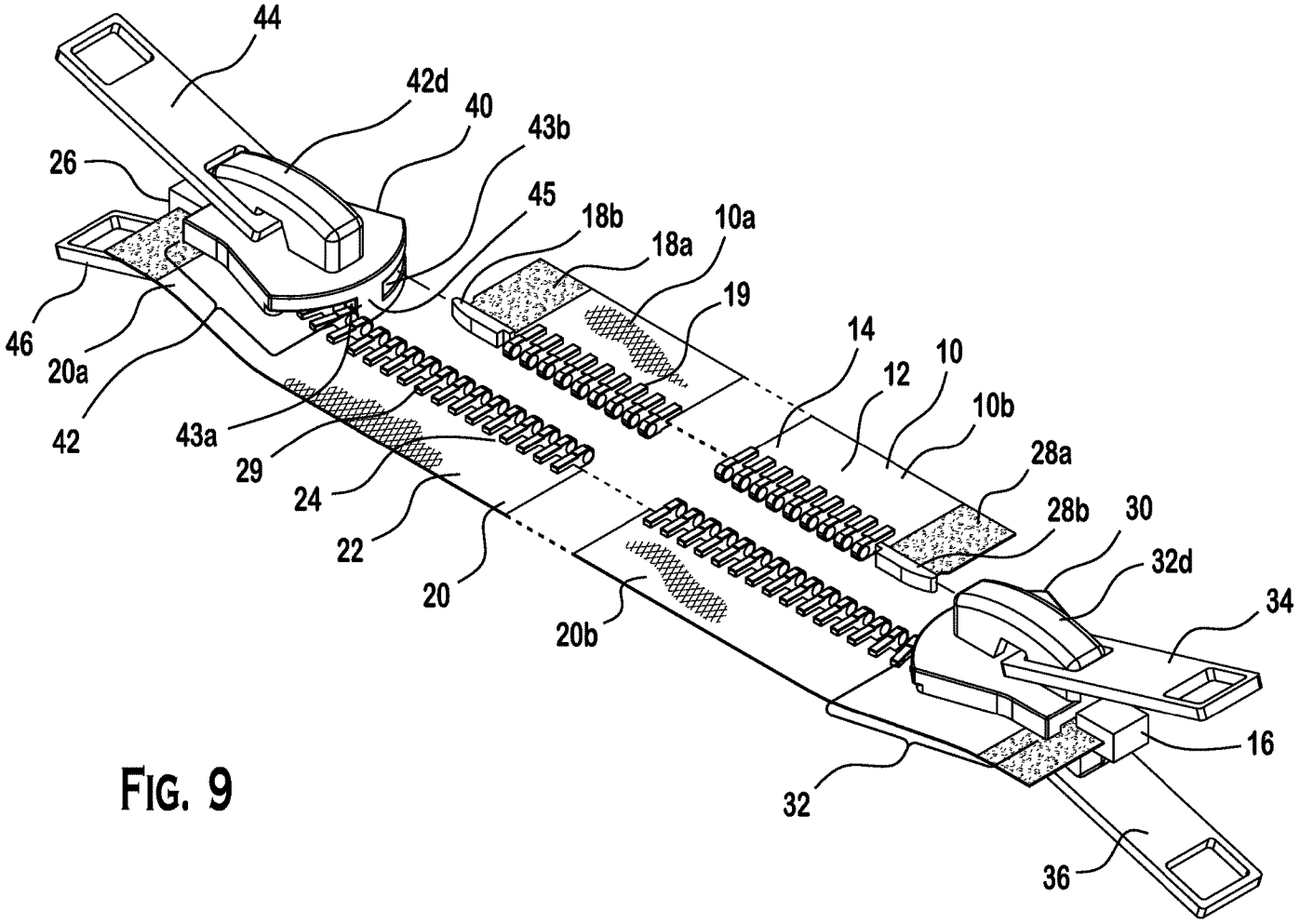
FIG. 9 is a perspective view of another zipper fastener system according to the invention.
Figure 10:
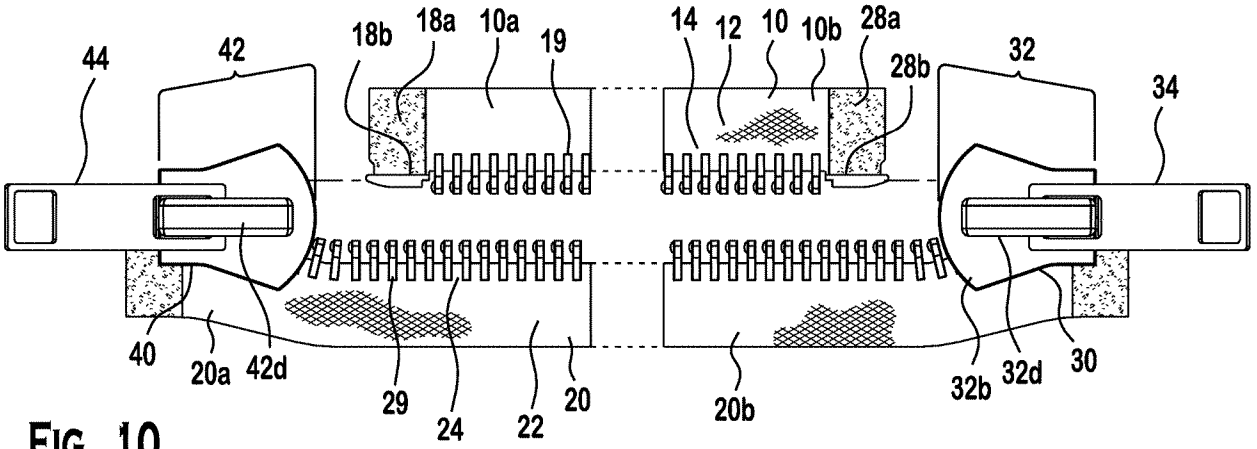
FIG. 10 is a top view of the zipper fastener system of FIG. 9.
Figure 11:
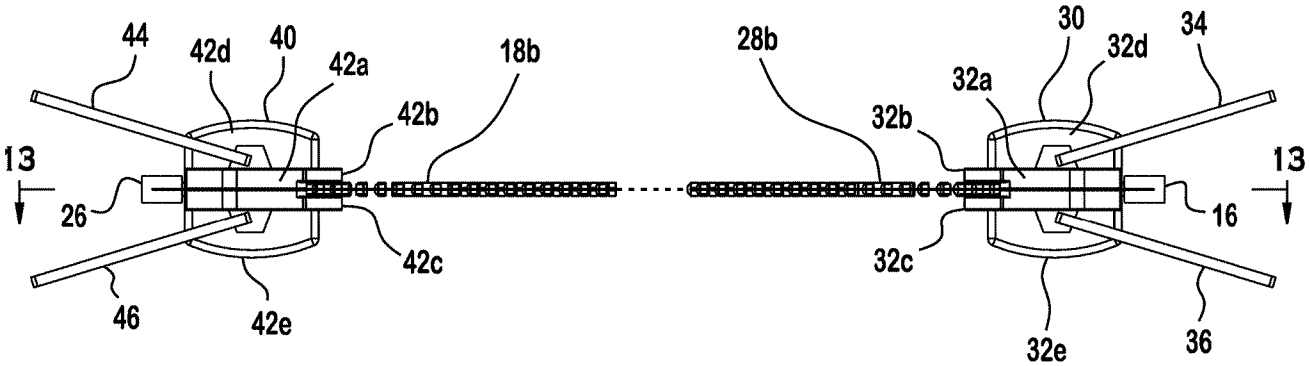
FIG. 11 is a left side view of the zipper fastener system of FIG. 9.
Figure 12:
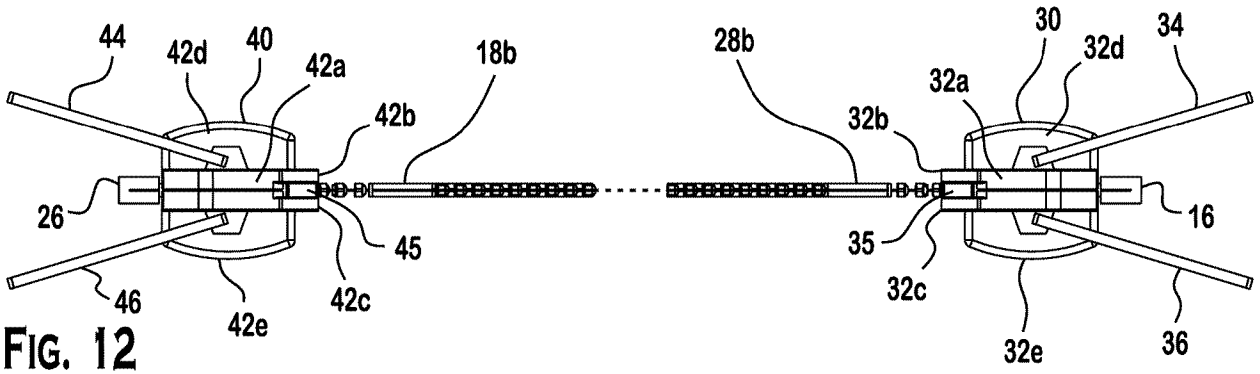
FIG. 12 a right side view of the zipper fastener system of FIG. 9.

As shown in FIGS. 6-8, the second tape section 20 (having a first end and a second end) includes a second connection section 22, a second set of fastener elements 24, the second retainer box 26, and a second retainer pin 28*b*.

The second connection section 22 (having a first end 22*a* and a second end 22*b*) is a strip of tape that extends along a length thereof. The second connection section 22 can be attached to a second structure (not shown), such as a garment, textile, or other materials, using stitching, mechanical weld, or adhesive. In particular, the second connection section 22 is attached to the second structure (not shown) along a left side thereof. The second structure is separate from the first structure. Removable attachment of the first structure to the second structure is desirable or advantageous. For instance, in one embodiment of the invention, the first structure may be a sleeping bag, a hammock, or a tent. For instance, the second structure may be a second sleeping bag, a second hammock, a second tent, a net, a tarp, a travel bag, etc.

The second set of fastener elements 24 are teeth in the shown first embodiment and are positioned along the length of the second connection section 22. The teeth of the second set of fastener elements 24 are positioned on a right side of the second connection section 22 and are generally parallel to each other. The teeth of the second set of fastener elements 24 extend away from the second connection section 22, substantially perpendicular to the length of the second connection section 22.

As shown in FIGS. 1-8, the second retainer box 26 is a box structure having a second retainer pin receiving cavity 27. The second retainer pin receiving cavity 27 is sized and shaped to correspond with the second tape section 20 and, more particularly, to receive a first retainer pin 28*b* thereof. The second retainer box 26 may include a magnet to facilitate assembly with the second tape section 20. As shown, the second retainer box 26 is attached to an upper end 20*a* of the second connection section 22. It is attached so as to prevent separation from the second connection section 22.

As shown in FIGS. 1-8, the second retainer pin 28*b* includes a second grip member 28*a* positioned adjacent to the second retainer pin 28*a*. The second retainer pin 28*b* is an elongated box shaped member that is generally rigid and dimensioned for insertion into the first slider 30 and the first tape section 10 and, more particularly, for insertion into the first retainer box 16. A second tooth member 29 may be provided at the top of the second retainer pin 28*b*. As shown, the second retainer pin 28*b* is attached to a lower end 20*b* of second connection section 22. It is attached so as to prevent separation from the second connection section 22.

Now with reference to FIGS. 9-13, another embodiment of the invention is described wherein the first and second retainer pins 18*b*, 28*b* are located at opposite ends of the same tape section (10 or 20 respectively) and the first and second retainer boxes 16, 26 are located at opposite ends of the remaining tape section. More particularly, the first retainer pin 18*b* and the second retainer pin 28*b* are attached to opposite ends of the same tape section. In the shown embodiment, one of the tape sections 10 or 20 includes both the first retainer pin 18*b* with a first grip member 18*a* and the second retainer pin 28*b* and second grip member 28*a* attached to opposite ends (i.e., to the lower end 10*b* and the upper end 10*a* of the first connection section 12 or to the upper end 20*a* and the lower end 20*b* of the second tape section 20). In such an embodiment, the remaining tape section that does not include first retainer pin 18*b* with first grip member 18*a* and the second retainer pin 28*b* and second grip member 28*a* instead includes both the first retainer box 16 having a first retainer pin receiving cavity 17 and the second retainer box 26 having a second retainer pin receiving cavity 27 attached to opposite ends (i.e., to the lower end and the upper end) of the remaining tape section. These are attached so as to prevent separation from the respective connection section 12. 22.

Now with reference to the FIGS. 1-13, the first slider 30 will be described. The first slider 30 includes a first slider body 32, a first outer pull tab 34, and a first inner pull tab 36.

The first slider body 32 includes a first main body 32*a*, a first upper arm 32*b*, a first lower arm 32*c*, a first outer tab connector 32*d*, and a first inner tab connector 32*e*. The first main body 32*a* is a vertical wall running a length thereof. The first upper arm 32*b* and the first lower arm 32*c* are wings that protrude laterally from the first slider body 32 with the first main body 32*a* running vertically with respect to the first upper arm 32*b* and the first lower arm 32*c*. As a result, the first main body 32*a* divides a receiving space between facing surfaces of the first upper arm 32*b* and the first lower arm 32*c*. As a result, the first slider body 32 includes a first fastener element receiving passageway 33*a* running along the length of one side of the first slider body 32. A second fastener element receiving passageway 33*b* is also provided and runs along the length of another side of the first slider body 32, which is opposite the first fastener element receiving passageway 33*a*. The first outer tab connector 32*d* is a looped structure for fastening or connecting the first outer pull tab 34. The first outer tab connector 32*d* is positioned on the outer wall of the first upper arm 32*b*. Likewise, the first inner tab connector 32*e* is also a looped structure for fastening or connecting the first inner pull tab 36. The first inner tab connector 32*e* is positioned on the outer wall of the first lower arm 32*c*. The first outer pull tab 34 and the first inner pull tab 36 are connected and movable with the first outer tab connector 32*d* and the first inner tab connector 32*e*, respectively.

In the shown embodiment, the first slider 30 is movably positioned adjacent to first retainer box 16 and is mounted on the first tape section 10, although it is free to move along the length thereof except as described below with reference to the second slider 40.

Now with reference to the FIGS. 1-13, the second slider 40 will be described. The second slider 40 includes a second slider body 42, a second outer pull tab 44, and a second inner pull tab 46.

The second slider body 42 includes a second main body 42*a*, a second upper arm 42*b*, a second lower arm 42*c*, a second outer tab connector 42*d*, and a second inner tab connector 42*e*. The second main body 42*a* is a vertical wall running a length thereof. The second upper arm 42*b* and the second lower arm 42*c* are wings that protrude laterally from the second slider body 42 with the second main body 42*a* running vertically with respect to the second upper arm 42*b* and the second lower arm 42*c*. As a result, the second main body 42*a* divides a receiving space between facing surfaces of the second upper arm 42*b* and the second lower arm 42*c*. As a result, the second slider body 42 includes a second fastener element receiving passageway 43*a* running along the length of one side of the second slider body 42. A first fastener element receiving passageway 43*b* is also provided and runs along the length of another side of the second slider body 42, which is opposite the second fastener element receiving passageway 43*a*.

The second outer tab connector 42*d* is a looped structure for fastening or connecting the second outer pull tab 44. The second outer tab connector 42*d* is positioned on the outer wall of the second upper arm 42*b*. Likewise, the second inner tab connector 42*e* is also looped structure for fastening or connecting the second inner pull tab 46. The second inner tab connector 42*e* is positioned on the outer wall of the second lower arm 42*c*. The second outer pull tab 44 and the second inner pull tab 46 are connected and movable with the second outer tab connector 42*d* and the second inner tab connector 42*e*, respectively.

In the shown first embodiment of FIGS. 6-8, the second slider 40 is movably attached adjacent to the second retainer box 26 and is mounted on the second tape section 20, although it is free to move along the length thereof.

Now with reference to FIGS. 9-13, another embodiment of the invention is described wherein the first and second sliders 30, 40 are movably attached adjacent to first and second retainer boxes 16, 26 respectively and located at opposite ends of the same tape section (10 or 20). First and second sliders 30, 40 are mounted on the same tape section, although each slider is free to move along the length thereof to the point of meeting the remaining slider. They are mounted so as to prevent separation from the connection section on which they are mounted.

More particularly in such another embodiment, the first slider 30 and the second slider 40 are mounted on the same tape section. The first slider 30 is movably attached adjacent to the first retainer box 16 and either the first retainer pin 18*b* or the second retainer pin 28*b* is positioned through first slider 30 and into the first retainer box 16. Likewise, in this embodiment, the second slider 40 is movably attached adjacent to the second retainer box 26 and the remaining retainer pin (either 28*b* or 18*b* respectively) is positioned through second slider 40 and into the second retainer box 26. They are mounted so as to prevent separation from the tape section.

Now with reference to the Figures, assembly and use of the zipper fastener system 1 according to the shown embodiments of the invention will be described.

The first connection section 12 is attached to a first structure (not shown), while the second connection section 22 is attached to a second structure (not shown).

In the first shown embodiment, in FIGS. 1-8, the first slider 30 is movably attached to first retainer box 16 and the second retainer pin 28*b* is positioned through first slider 30 and into the first retainer box 16. Likewise, in the shown first embodiment, the second slider 40 is movably attached to the second retainer box 26 and the first retainer pin 18*b* is positioned through second slider 40 and into the second retainer box 26.

The first slider 30 moves along the first tape section 10 such that the first set of fastener elements 14 engages and connects with the second set of fastener elements 24. Likewise, the second slider 40 moves along the second tape section 20 such that the second set of fastener elements 24 engages and connects with the first set of fastener elements 14. Accordingly, the first tape section 10 and second tape section 20 can be connected together and secured, or can be removed and separated from each other.

Likewise, in other shown embodiment, FIGS. 8-13, wherein the first and second retainer pins 18, 28 are located at opposite ends of the same tape section, 10 or 20, respectively, the first slider 30 is movably placed adjacent to the first retainer box 16 and the second retainer pin 28*b* is positioned through first slider 30 and into the first retainer box 16. As well, in this shown embodiment, the second slider 40 is movably placed adjacent to the second retainer box 26 and the first retainer pin 18*b* is positioned through second slider 40 and into the second retainer box 26.

After the first retainer pin 18*b* is positioned into the first retainer box 16 as described above, the first slider 30 moves along the first tape section 10 such that the first set of fastener elements 14 engages and connects with the second set of fastener elements 24. Likewise, after the second retainer pin 28*b* is positioned into the second retainer box 26 as described above, the second slider 40 moves along the first tape section 10 such that the second set of fastener elements 24 engages and connects with the first set of fastener elements 14. The first slider and second slider are independently moved by means of the inner or outer pull tabs along the first and second tape sections. Accordingly, the first tape section 10 and second tape section 20 can be connected together and secured, or can be removed and separated from each other.

Regardless of whether invention is operated having the first and second retainer pins 18*b*, 28*b* and the corresponding first and second retainer box 16, 26 located on the same tape sections, or in the alternative, wherein the first and second retainer pins 18*b*, 28*b* and the corresponding first and second retainer box 16, 26 are located on different tape sections, the first slider 30 and the second slider 40 can be movably positioned to engage and connect the first set of fastener elements 14 with the second set of fastener elements 24. The first slider 30 and the second slider 40 may be so positioned on first tape section 10 and second tape section 20 such that, as between the first set of fastener elements 14 and the second set of fastener elements 24, there is a passageway which can be varied in length in position along the first and second tape sections 10, 20. Alternatively, the first slider 30 and the second slider 40 may be so positioned adjacent to each other along the first and second tape sections 10, 20 such that there is no open passageway. The inner and outer pulls allow positioning of the sliders independently along the first and second tape sections as desired by the user from either outside the joined first and second structures or from within the joined first and second structures.

While the invention has been described in detail and with reference to specific embodiments, one of ordinary skill in the art would appreciate that the described embodiments are illustrative, and that various changes and modifications can be made without departing from the scope of the invention.

What is claimed is:

1. A zipper fastener system, comprising:

a first tape section having:

a first set of fastener elements extending along a length thereof;

a first retainer box positioned at a first end of the first set of fastener elements;

a second retainer box positioned at a second end of the first set of fastener elements that is positioned opposite the first retainer box;

a first slider movably attached to the first tape section and engageable with the first retainer box, the first slider having:

a first slider body with a first outer tab connector and a first inner tab connector;

a first outer pull tab connected to the first outer tab connector; and a first inner pull tab connected to the first inner tab connector;

a second slider movably attached to the first tape section and engageable with the second retainer box, the second slider having:

a second slider body with a second outer tab connector and a second inner tab connector;

a second outer pull tab connected to the second outer tab connector; and a second inner pull tab connected to the second inner tab connector; and a second tape section having:

a second set of fastener elements extending along a length thereof and engageable with the first set of fastener elements;

a first retainer pin positioned at a first end of the second set of fastener elements and corresponding to the first retainer box and the first slider; and a second retainer pin positioned at a second end of the second set of fastener elements that is positioned opposite the first retainer pin, the second retainer pin corresponding to the second retainer box and the second slider.

2. The zipper fastener system of claim 1, wherein the first outer pull tab and the first inner pull tab are independently connected to and movable with the first outer tab connector and the first inner tab connector, respectively.

3. The zipper fastener system of claim 1, wherein the second outer pull tab and the second inner pull tab are independently connected to and movable with the second outer tab connector and the second inner tab connector, respectively.

4. The zipper fastener system of claim 1, wherein the first retainer box includes a first retainer pin receiving cavity sized and shaped to correspond with the first retainer pin.

5. The zipper fastener system of claim 1, wherein the second retainer box includes a second retainer pin receiving cavity sized and shaped to correspond with the second retainer pin.

6. The zipper fastener system of claim 1, wherein the first retainer pin includes a first tooth member provided at a top of the first retainer pin.

7. The zipper fastener system of claim 1, wherein the first retainer pin includes a first grip member is provided adjacent to the first retainer pin on the second tape section.

8. The zipper fastener system of claim 1, wherein the second retainer pin includes a second tooth member provided at a top of the second retainer pin.

9. The zipper fastener system of claim 1, wherein the second retainer pin includes a second grip member is provided adjacent to the second retainer pin on the second tape section.

10. The zipper fastener system of claim 1, wherein the first tape section and the second tape section are connected after inserting the first retainer pin into the first slider and the first retainer box and inserting the second retainer pin into the second slider and the second retainer box and then independently moving, respectively, the first slider and the second slider along the first and second sets of fastener elements of the first and second tape sections by use of an inner or outer pull tabs.

11. A zipper fastener system, comprising:

a first tape section having:

a first set of fastener elements extending along a length thereof;

a first retainer box positioned at a first end of the first set of fastener elements;

a first retainer pin positioned at a second end of the first set of fastener elements; and a first slider movably attached to the first tape section and engageable with the first retainer box, the first slider having:

a first slider body with a first outer tab connector and a first inner tab connector;

a first outer pull tab connected to the first outer tab connector; and a first inner pull tab connected to the first inner tab connector; and a second tape section having:

a second set of fastener elements extending along a length thereof and engageable with the first set of fastener elements;

a second retainer box positioned at a second end of the second set of fastener elements of the second tape section;

a second retainer pin positioned at a first end of the second set of fastener elements and corresponding to the first retainer box and the first slider; and a second slider movably attached to the second tape section and engageable with the second retainer box, the second slider having:

a second slider body with a second outer tab connector and a second inner tab connector;

a second outer pull tab connected to the second outer tab connector; and a second inner pull tab connected to the second inner tab connector.

12. The zipper fastener system of claim 11, wherein the first outer pull tab and the first inner pull tab are independently connected to and movable with the first outer tab connector and the first inner tab connector, respectively.

13. The zipper fastener system of claim 11, wherein the second outer pull tab and the second inner pull tab are independently connected to and movable with the second outer tab connector and the second inner tab connector, respectively.

14. The zipper fastener system of claim 11, wherein the first retainer box includes a first retainer pin receiving cavity sized and shaped to correspond with the second retainer pin.

15. The zipper fastener system of claim 11, wherein the second retainer box includes a second retainer pin receiving cavity sized and shaped to correspond with the first retainer pin.

16. The zipper fastener system of claim 11, wherein the first retainer pin includes a first tooth member provided at a top of the first retainer pin.

17. The zipper fastener system of claim 11, wherein the first retainer pin includes a first grip member is provided adjacent to the first retainer pin on the first tape section.

18. The zipper fastener system of claim 11, wherein the second retainer pin includes a second tooth member provided at a top of the second retainer pin.

19. The zipper fastener system of claim 11, wherein the second retainer pin includes a second grip member is provided adjacent to the second retainer pin on the second tape section.

20. The zipper fastener system of claim 11, wherein the first tape section and the second tape section are connected after inserting the first retainer pin into the second slider and the second retainer box and inserting the second retainer pin into the first slider and the first retainer box and then independently moving, respectively, the first slider and the second slider along the first and second sets of fastener elements of the first and second tape sections by use of an inner or outer pull tabs.

* * * * *